United States Patent [19]

Wollam et al.

[11] 4,387,123

[45] Jun. 7, 1983

[54] COATING PROCESS AND APPARATUS

[75] Inventors: Carl A. Wollam, Cortland; J. Lynn Gailey, Newton Falls, both of Ohio

[73] Assignee: Alcan Aluminum Corporation, Cleveland, Ohio

[21] Appl. No.: 226,699

[22] Filed: Jan. 21, 1981

[51] Int. Cl.[3] ..... B05C 3/132; B05D 3/02; B05D 3/12; B05D 5/00

[52] U.S. Cl. ..... 427/286; 118/410; 118/411; 118/412; 118/415; 427/356; 427/358; 427/388.1; 427/369; 118/122

[58] Field of Search ..... 118/411, 412, 415, 410, 118/122; 427/356, 357, 358, 286, 388.1, 369

[56] References Cited

U.S. PATENT DOCUMENTS

| | | | |
|---|---|---|---|
| 2,695,005 | 11/1954 | Lewin et al. | 118/415 X |
| 3,106,480 | 10/1963 | Baker | 427/286 |
| 3,886,898 | 6/1975 | Colegrove et al. | 118/413 X |
| 4,143,187 | 3/1979 | Pilgrim et al. | 427/358 |
| 4,246,335 | 1/1981 | Keogh et al. | 430/278 |

FOREIGN PATENT DOCUMENTS

| | | | |
|---|---|---|---|
| 283973 | 7/1965 | Australia | 427/286 |

*Primary Examiner*—Michael R. Lusignan

*Attorney, Agent, or Firm*—Cooper, Dunham, Clark, Griffin & Moran

[57] ABSTRACT

In the coating of a strip article of indeterminate length, wherein the article is continuously advanced lengthwise past a dam while liquid coating material is supplied to a major surface of the article ahead of the dam, the article is passed through a gap of extended length immediately beyond the dam, the gap being defined between uniformly spaced walls one of which faces the article surface bearing the coating material. The spacing between the gap walls is equal to the thickness of the strip article plus a desired wet thickness of the layer of coating material. Coating material of different colors or shades may be supplied to different portions of the strip surface for producing coatings of varied patterns.

18 Claims, 20 Drawing Figures

Fig. 4.
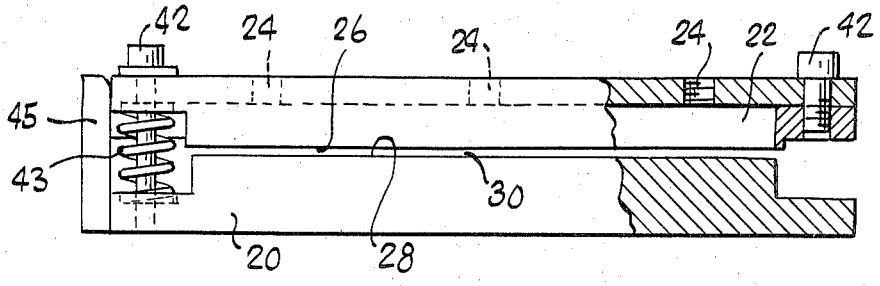
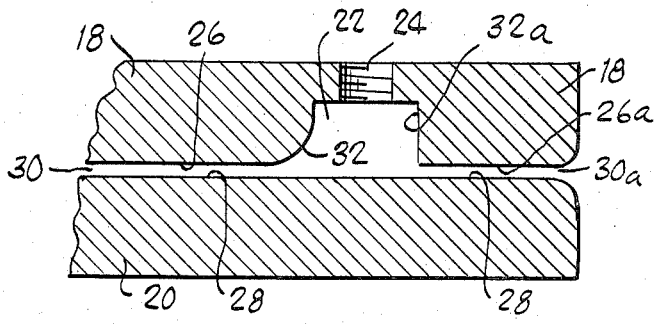
Fig. 5.
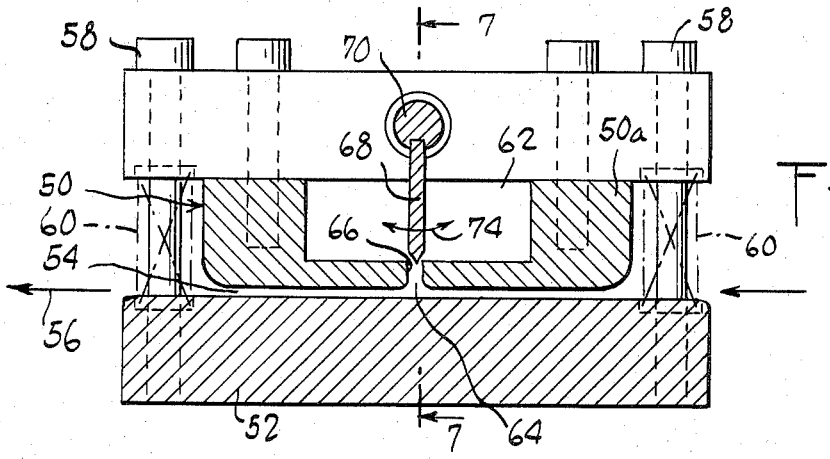
Fig. 6.
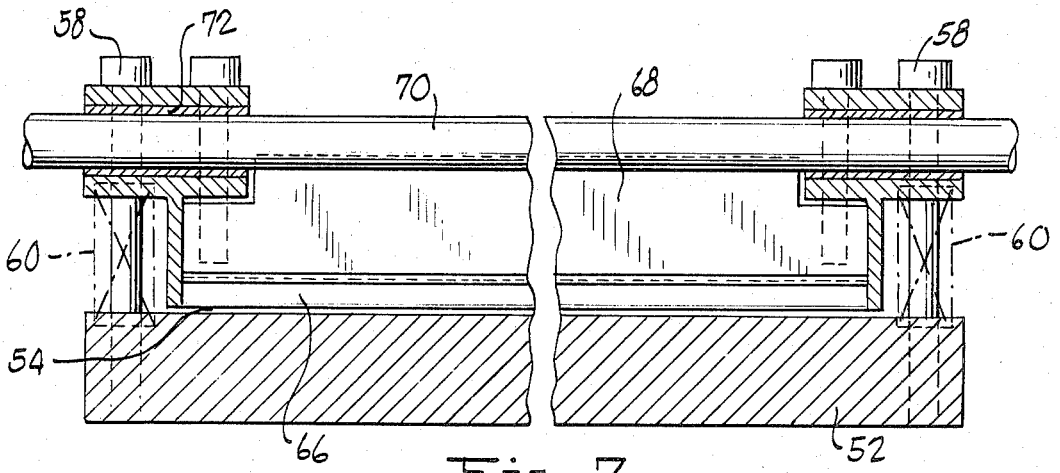
Fig. 7.

Fig. 9.
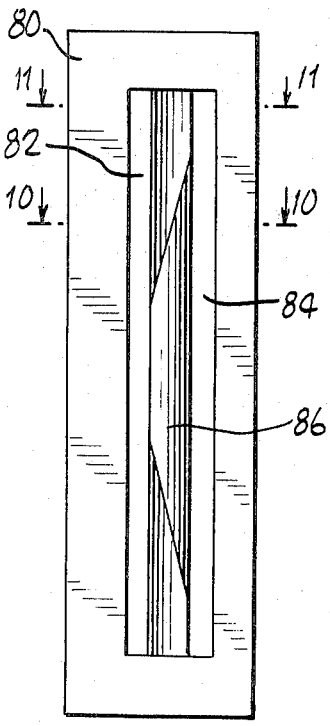
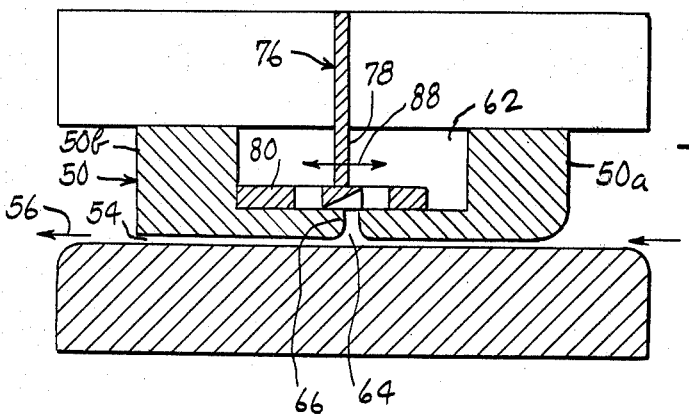
Fig. 8.
Fig. 10.
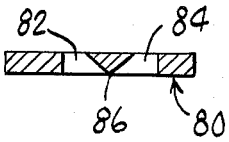
Fig. 11.
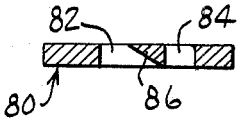
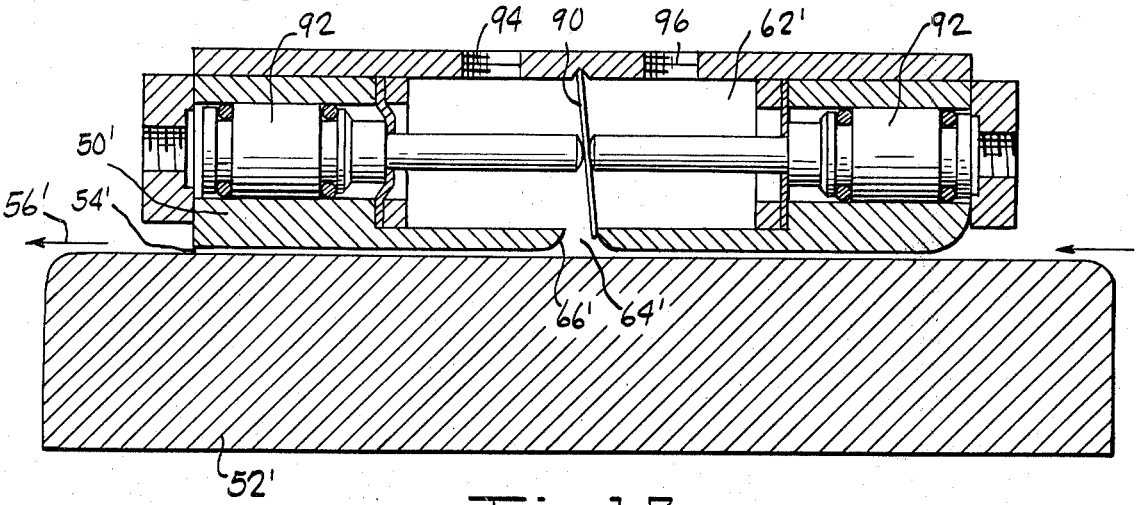
Fig. 13.

Fig. 14.
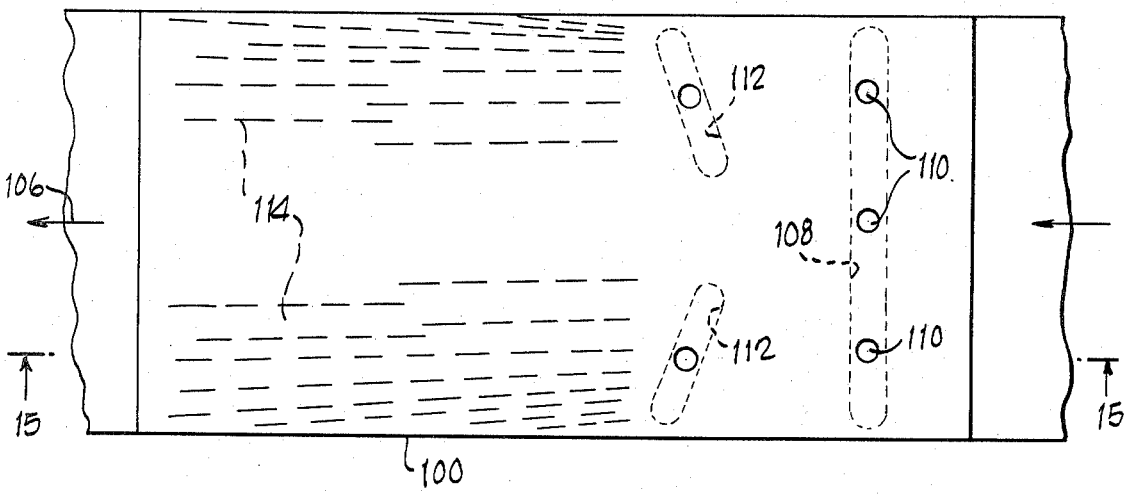
Fig. 15.
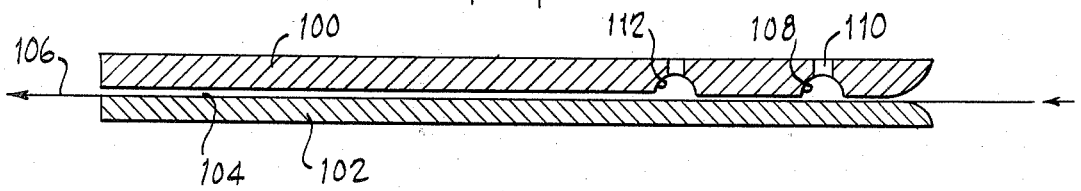
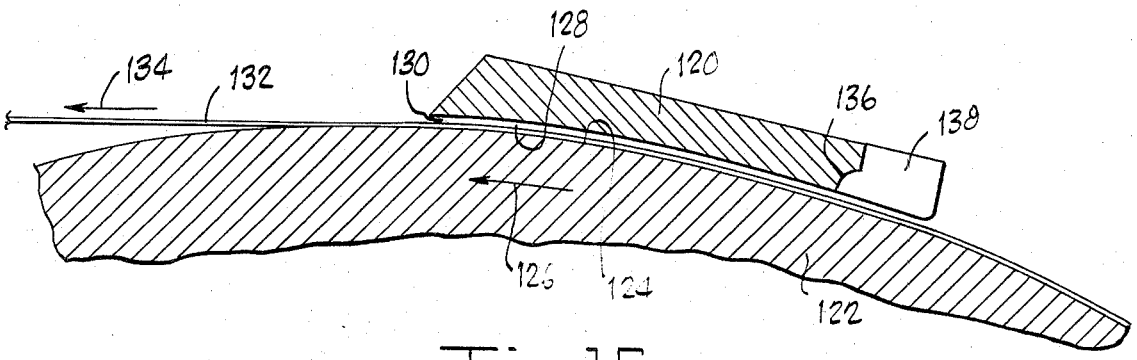
Fig. 16.

Fig. 17.
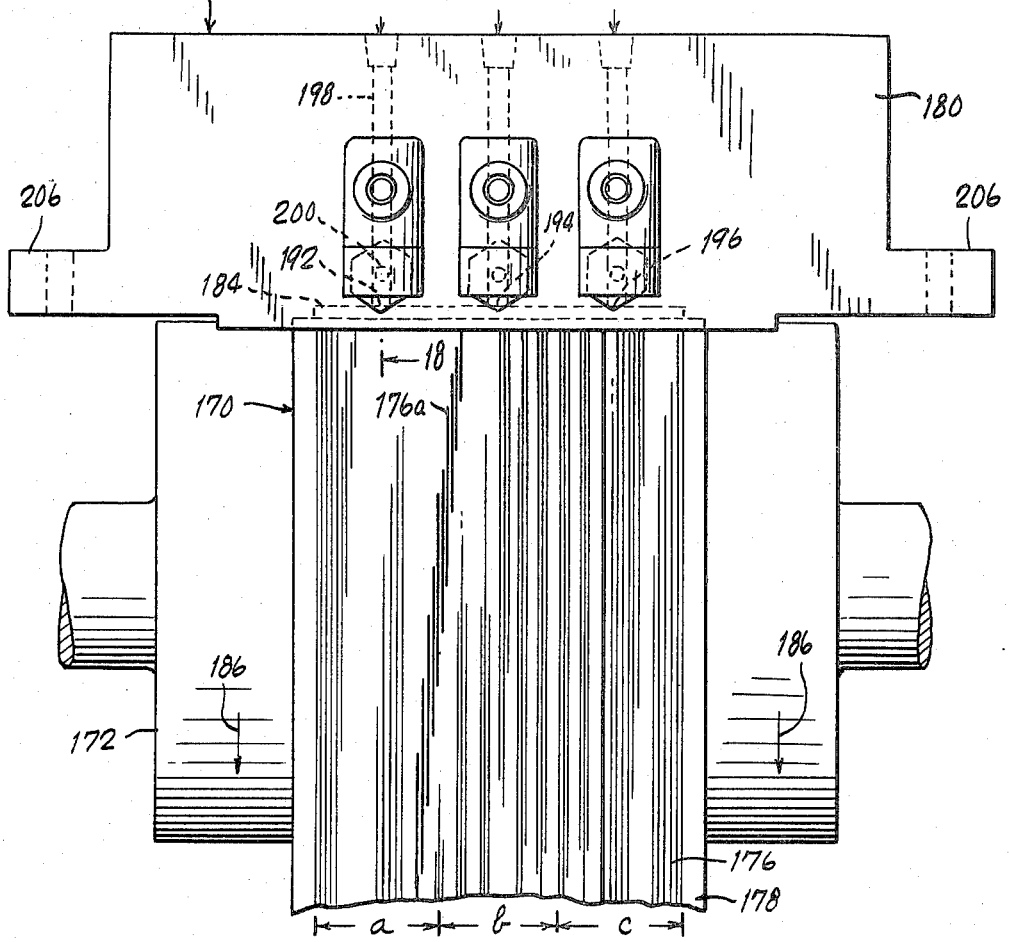
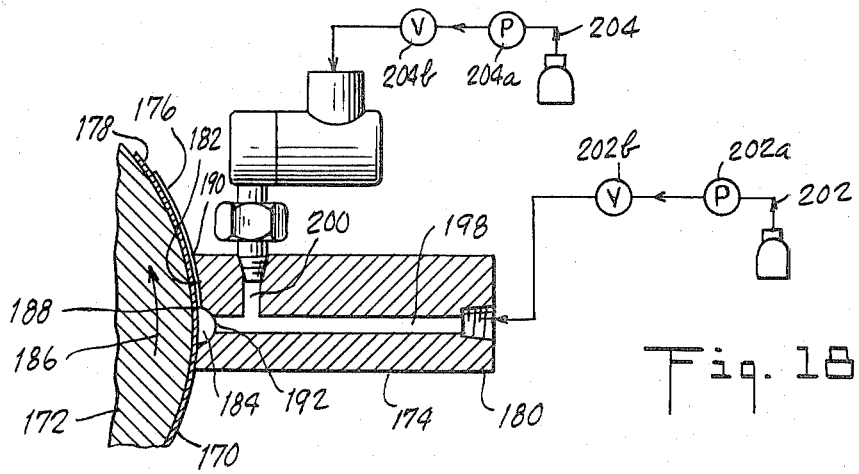
Fig. 18.

COATING PROCESS AND APPARATUS

DESCRIPTION

BACKGROUND OF THE INVENTION

This invention relates to coating processes and apparatus, and in particular to processes and apparatus for coating surfaces of strip articles of indeterminate length.

In coating operations as herein contemplated, an initially wet, flowable coating material is applied to a surface of a substrate that is at least substantially impervious thereto, for covering the substrate surface with a continuous adherent coating layer. One especially important application of the invention, to which detailed reference will be made for purposes of illustration, is the coating of metal strip with a protective and/or decorative layer of paint or the like, prior to cutting or forming of the strip into shingles, siding or soffit panels, building trim members, or other products.

Metal strip (i.e. strips of sheet metal of indeterminate length, usually stored as coils) is continuously coated, in commercial practice, by advancing the strip longitudinally past a locality where a wet coating material such as paint is applied to one or both major surfaces of the strip, and then through a zone where the coating is cured or dried with heat. Known techniques for applying wet coating material to a strip surface include spraying, transfer from rolls, and deposit of the coating material on the strip surface immediately ahead of a doctor blade or dam which has the purpose of establishing a desired coating thickness. In the latter instance, the blade or dam, as will be understood, has a thin edge extending transversely across and very slightly spaced from the surface to be coated; the deposited wet coating material puddles on the upstream side of the blade or dam and is carried thereunder in a thin layer on the moving surface.

While coating operations using a blade or dam are advantageous from the standpoint of mechanical simplicity, they (like other coating techniques, e.g. spray and roll-coating) do not afford assured or easily attainable high uniformity of coating thickness, especially in the coating of metal strip which commonly has wavy edges, an "oil-canned" central area, or other slight deformations tending to cause variation in the effective spacing between the blade or dam edge and the strip surface and consequently in the thickness of the coating layer determined by that spacing. In order to achieve an adequate coating thickness at all points on the strip surface, therefore, it is commonly necessary to apply a coating layer having a greater average thickness (and thus to consume more coating material) than would be required if the thickness could be made more uniform. This consumption of excess coating material is economically undesirable.

An additional disadvantage of such conventional coating arrangements is the waste of coating material that occurs, e.g. through overflow, owing inter alia to shortcomings in the effectiveness of the metering action provided by these arrangements. Moreover, there is a tendency for air to be picked up in the coating material ahead of the doctor blade, and to become entrapped in the coating, especially at fast coating speeds.

Further complications are encountered when it is attempted by conventional means to provide a coating layer having a striped, streaked, marbleized or otherwise variegated pattern. It has been proposed (in U.S. Pat. No. 3,106,480) to supply paint of different colors to different locations along a common reservoir defined in the nip between two rolls, one of which transfers the paint from the reservoir to a sheet surface to be coated; but in use of blade or dam-type coating arrangements (which, as noted, offer the important advantage of mechanical simplicity) it has heretofore been considered necessary to provide separators for isolating the different colors in the coating material pool or puddle upstream of the dam, as shown for example in U.S. Pat. Nos. 2,695,005 and 3,886,898. Such separators add to the structural complexity of the coating apparatus and prevent or at least greatly restrict the provision of controlled variation in the color patterns produced.

SUMMARY OF THE INVENTION

The present invention broadly contemplates the provision of strip-coating processes and apparatus of the general type employing a dam extending transversely across a major surface of a longitudinally advancing strip, with deposit of wet coating material on that strip surface immediately ahead of the dam, wherein, immediately beyond the dam, the strip is advanced longitudinally past a smooth and rigid wall (facing the coated strip surface) of extended length in the direction of strip advance, and of width at least equal to the width of the coated strip surface, and wherein during such advance past the wall the strip is uniformly restrained against movement of its coated surface more than a predetermined distance away from the aforementioned wall (i.e. in a direction normal to the direction of strip advance), such predetermined distance being equal to the desired coating thickness. The means for thus restraining the strip may, for example, comprise a second wall spaced uniformly from the first-mentioned wall so as to define therewith a gap (through which the strip advances) equal in width to the sum of the strip thickness and the desired coating thickness.

This feature of advancing the strip past a wall of extended length, immediately beyond the dam, while uniformly restraining the strip against movement away from the wall beyond a predetermined distance, is found to produce an advantageously high uniformity of coating thickness even on strip which may be wavy-edged, oil-canned, or otherwise deformed. As at present believed, the applied wet coating material, lying under pressure between one surface of the strip and the facing wall (relative to which the strip is moving), forces the strip away from the wall by a hydroplaning action, thereby (i.e. since the strip is uniformly restrained against such movement beyond a predetermined distance) smoothing out the strip deformations for the duration of advance of the strip past the wall so as to achieve substantial uniformity of spacing between all points on the coated strip surface and the facing wall. The latter spacing determines the wet thickness of the coating; hence the coating on the strip is of desirably uniform thickness, notwithstanding that the strip deformations reappear as the strip emerges beyond the wall. Moreover, the invention provides better metering of the coating material than conventional techniques using rolls or doctor blades; substantially all the supplied coating material is usefully consumed to provide the desired coating, with virtually no loss due to spillage over the sides. A further advantage of the invention resides in avoidance of entrapment of air in the coating.

Preferably in at least many instances, and as a further feature of the invention, the downstream end of the wall facing the coated strip surface (i.e. the end remote from the dam in the direction of strip advance) is a sharp edge providing an abrupt surface discontinuity rather than a radiused edge which could cause cavitation problems and resultant irregulatities in the produced coating. Thus, the downstream wall edge may be constituted as the intersection of the strip-facing wall surface with a surface (of the wall structure) facing downstream and lying in a plane oriented at an angle of at least about 90° to the direction of strip advance. On the other hand, it is preferred that the dam at or constituting the upstream end of the wall have a radiused or chamfered edge for leading the coating material onto the strip surface and gradually initiating the fluid pressure which, between the wall and the strip surface, provides the above-described hydroplaning effect. It is also frequently preferable that the body or pool of liquid coating material ahead of the dam be maintained under positive pressure.

It is additionally found that the process and apparatus of the invention enable stripes and other variegated patterns of colors or shades to be achieved in the produced coating by supplying coating material of different colors or shades to different portions (spaced across the width of the strip) of a single continuous pool or puddle of the coating material extending along the inlet side of the dam, i.e. without employing any separators to isolate these different shades or colors in the pool. The nature of the patterns produced is dependent on the locations and relative quantities of the different shades or colors thus supplied, and can be controllably varied as desired during the coating of a single continuous strip surface by varying one or more of these factors. The invention in particular embodiments includes means for effecting such variation.

In apparatus in accordance with the invention, the wall facing the coated surface of the strip is conveniently an extended surface of a stationary plate past which the strip advances, an upstream portion of the plate being shaped to constitute the dam, although it will be understood that in a broad sense the requisite movement of the strip relative to this facing wall could be achieved by moving the wall along a stationary strip. The means for restraining the strip against movement away from this wall can also be a wall constituted by a stationary plate. In some embodiments of the invention, however, this other wall is an endless surface moving in the same direction and at the same rate as the strip, so as to prevent abrasion.

Further features and advantages of the invention will be apparent from the detailed description hereinbelow set forth, together with the accompanying drawings.

BRIEF DESCRIPTION OF THE DRAWINGS

FIG. 4 is a cross-sectional elevational view taken along the line 4—4 of FIG. 3;

FIG. 5 is an enlarged fragmentary sectional view taken along the line 5—5 of FIG. 2;

FIG. 6 is a side elevational view of another embodiment of the apparatus of the invention;

FIG. 7 is a fragmentary cross-sectional elevational view taken along the line 7—7 of FIG. 6;

FIG. 8 is a side elevational view of a further modified embodiment of the apparatus of the invention;

FIG. 9 is a bottom view of the coating supply-controlling element of the apparatus of FIG. 8;

FIGS. 10 and 11 are, respectively, cross-sectional views taken along the lines 10—10 and 11—11 of FIG. 9;

FIG. 13 is a side elevational sectional view taken along the line 13—13 of FIG. 12;

FIG. 14 is a simplified schematic plan view of yet another embodiment of the apparatus of the invention;

FIG. 5 is a side elevational sectional view taken along the line 15—15 of FIG. 14;

FIG. 16 is a simplified schematic side elevational view of a still further embodiment of the apparatus of the invention;

FIGS. 17 and 18 are plan and sectional views, respectively, of another embodiment of the invention;

DETAILED DESCRIPTION

Figure 1:
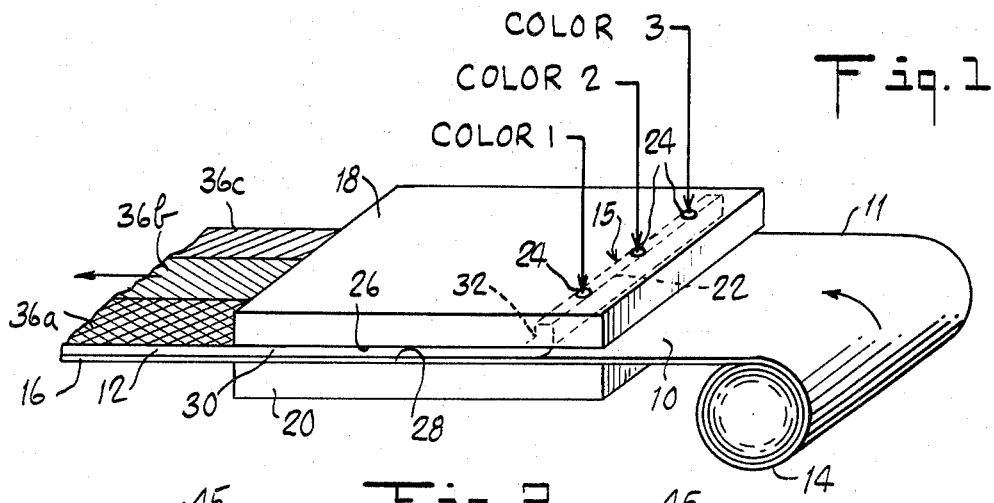
FIG. 1 is a simplified schematic perspective view illustrating the performance of the process of the present invention in an illustrative embodiment.
Figure 2:
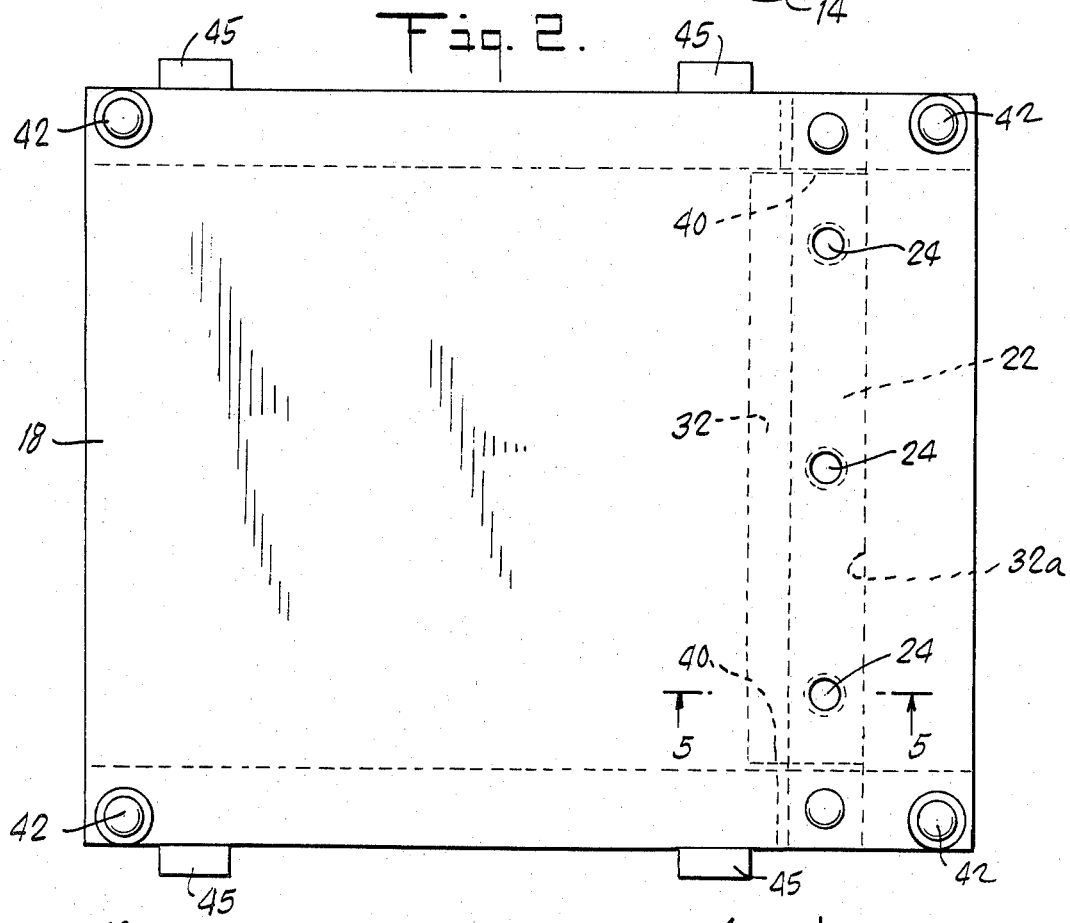
FIG. 2 is a plan view of one embodiment of the apparatus of the invention, suitable for performing the process of FIG. 1.

Referring first to FIG. 1, the invention will be described as embodied in a process for continuously coating one major surface 10 of a metal (e.g. aluminum) strip 11 of indeterminate length with a continuous layer 12 of an initially wet coating material, such as paint, extending over the entire strip surface. For such coating, the strip is continuously advanced longitudinally (as from a supply coil 14) along a defined path past a locality 15 at which the wet paint is applied to the surface 10, and thence to a heating zone (not shown) where the coating is cured or dried. The other major surface 16 of the strip can be coated before or after the described coating of the surface 10, or left uncoated. Once the coating of the strip is complete, it can be formed and cut into a desired product such as siding panels.

The apparatus with which the process of the invention is performed is shown (by way of example) in FIG. 1 as comprising a pair of rigid flat plates 18 and 20 fixedly mounted, in superposed facing uniformly spaced relation to each other, at a portion of the path of advance of the strip 11 at which the strip major surfaces are substantially horizontal with surface 10 facing upwardly, the plates 18 and 20 being respectively disposed above and below the strip so that the path of strip advance passes between them. The upper plate or coating head 18 has an elongated reservoir cavity 22 dimensioned to extend across the full width of the strip 11 and opening downwardly toward the strip upper surface 10, for confining a body or pool of liquid coating material such as paint in contact with the strip surface 10. Paint is supplied to the cavity 22 through a plurality of passages 24 opening downwardly through the upper surface of the plate 18 into the cavity at locations spaced along the length thereof, i.e. across the width of the strip 11. Immediately beyond the cavity 22, the plate has a smooth, downwardly facing horizontal planar surface 26 that extends across the full width of the strip and also extends downstream from the cavity for a substantial distance in the direction of strip advance; the lower plate 20 has a smooth upwardly-facing horizontal planar surface 28 also extending across the full width of the strip and longitudinally of the strip over at least the full extent of the upper plate surface 26.

The surfaces 26 and 28 respectively constitute the upper and lower walls of a gap 30 of extended length in the direction of strip advance. Since these surfaces 26 and 28 lie in parallel horizontal planes (and are thus spaced apart by a uniform distance at all points) the gap 30 is of uniform height. The spacing between the two plate surfaces (i.e. the height of gap 30) is selected to be equal to the thickness of the strip 11 plus a desired wet thickness of coating layer on the strip surface 10, and is maintained at a fixed value during any given coating operation, although the spacing between the plates may be adjustable. The internal surface 32 of the upper plate 18 which defines the downstream side of the reservoir cavity 22 constitutes a dam, extending transversely across the strip surface 10 at the inlet end of the gap 30 and retaining the coating material on its upstream side in the reservoir.

In the practice of the present process, the locality 15 at which the coating material is applied to the strip surface 10 is the location of the reservoir cavity 22. As the strip advances past the cavity, the surface 10 is progressively brought into contact with the pool of wet flowable coating material therein, across its full width. The advancing movement of the strip draws coating material from the cavity on the strip surface 10 into the gap 30, i.e. into the space between the strip surface 10 and the facing gap wall 26, filling that space and forcing the strip against the other gap wall 28 notwithstanding any undulating or other deformation initially present in the strip. In this way, as the strip advances through the gap, the distance from the strip surface 10 to the gap wall 26 becomes uniform at all points and, since the space therebetween is filled with flowable coating material, a uniform wet thickness of coating layer over the entire surface 10 is achieved, even though as the strip emerges from the gap at the outlet or downstream end thereof any deformation initially present in the strip reappears. Thus, with progressive supply of wet coating material to cavity 22 (by gravity feed, in the embodiment shown) at a rate sufficient to maintain the gap 30 completely filled, the strip surface 10 is uniformly and continuously coated.

When paint of a single color is supplied to the cavity 22 through all the passages 24, a single-color coating is produced. Striped or other desired pattern effects can be achieved by supplying paint of different colors or shades through the different passages. For example, if the passages 24 are respectively located at the centerlines of longitudinal zones of equal width on the strip surface, and are all supplied with equal volumes of paint per unit time (in respectively different colors 1, 2 and 3), the produced coating will be constituted of well-defined parallel stripes **36*a*, 36*b*, 36*c* of the different colors without significant blurring or blending between stripes, even through the cavity 22** is a single, continuous, undivided reservoir. The stripes can be varied in relative width during the coating operation, and blended effects can be achieved, by varying the relative rates of feed of paint to the different passages. Thereby, controllably varied color patterns of longitudinal stripes or striations can readily and conveniently be produced on the coated surface.

The structure of the coating apparatus of FIG. 1 is illustrated in further detail in FIGS. 2–5. As there shown, the coating cavity 22 is machined across the width of the upper plate 18 and is provided with end plugs 40 for laterally enclosing the cavity to confine the liquid coating material therein. The plates 18 and 20 are secured together by means of bolts 42 respectively located at each corner of the plates. Each bolt 42 is inserted downwardly through a hole in the top plate 18 and is threaded into the bottom plate 20; a helical spring 43 is disposed in surrounding relation to the shank of each bolt 42 between the plates and is under compression between the plates 18 and 20. The bolts and springs serve to maintain the facing surfaces 26, 28 of the two plates (which, in this embodiment, are both highly polished planar surfaces) uniformly spaced apart over the full lateral and longitudinal extent of the gap 30, and to maintain that spacing fixed during any given coating operation while permitting adjustment of the spacing (for selection of a desired coating thickness) before the coating operation has begun. As a further aid in positionally stabilizing the plates, bars 45 are bolted to both sides of the bottom plate 20 and project upwardly therefrom along the sides of the plate 18 to prevent relative lateral displacement of the plates.

Figure 3:
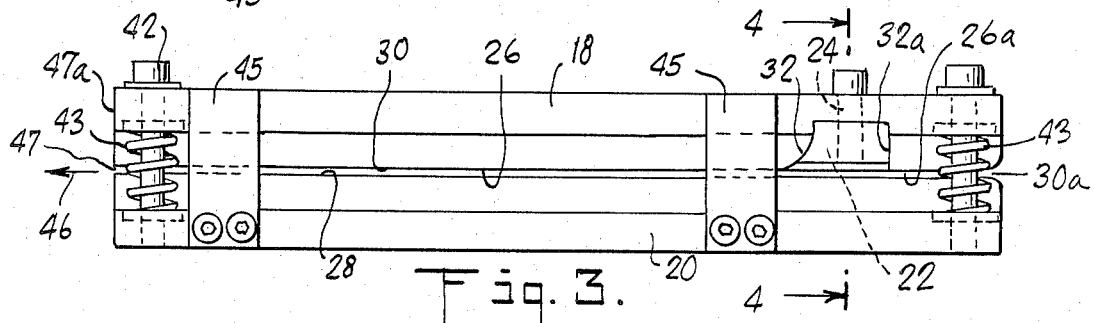
FIG. 3 is a side elevational view of the apparatus of FIG. 2.

As best seen in FIGS. 3 and 5, in this embodiment of the apparatus the horizontal planar surface 28 of the lower plate 20 extends for some distance upstream of the coating cavity 22 and faces a horizontal planar surface portion **26*a* of the upper plate 18 ahead of cavity 22. The spacing between the upstream portion of surface 28 and the surface 26*a* of plate 18 is equal to the spacing between surfaces 26 and 28; i.e. the surface 26*a* together with the portion of surface 28 subjacent thereto cooperatively define a gap 30*a* equal in height to gap 30** and having an extended length along the path of strip advance.

In an illustrative example of apparatus of the type shown in FIGS. 2–5, the width of the surfaces 26, 28 and **28*a* is between $7\frac{7}{8}''$ and $8''$ for coating strip less than $7\frac{7}{8}''$ wide, and the length of surface 26 (which, with surface 28, defines gap 30) is slightly less than $9''$ in the direction of strip travel. The length of surface 26*a*, which, with the subjacent upstream portion of surface 28, defines the gap 30*a*, is about $1\frac{1}{4}''$ along the path of strip travel. With apparatus having these dimensions, it is found that both gaps 30 and 30*a* are of sufficiently extended length to provide the advantageous results of the invention with respect to uniformity of coating thickness and attainment of desired striped or other pattern effects; i.e. when the direction of strip travel is reversed from that indicated by arrow 46 in FIG. 3, so that the gap 30*a* rather than the gap 30 is traversed by the strip after application of coating to its surface in the cavity 22, the gap 30*a* is found to be of sufficiently extended length in the direction of strip advance to substantially achieve the beneficial results of uniformity of coating thickness and production of desired pattern effects. In this reversely directed operation, of course, the surface 32*a* of the cavity 22 (opposite the previously described surface 32**) functions as the dam.

As shown, the dam surface 32 is radiused to lead the liquid coating material onto the strip and to provide, as the strip advances past the dam, progressive development of the fluid pressure which causes hydroplaning action (forcing the strip uniformly against the plate 20) within the gap between the plates; alternatively, the surface 32 may be chamfered. It will be understood that in this embodiment, the surface 26 of the plate 18 constitutes the wall facing the coated strip surface, and the plate 20 constitutes the means for uniformly restraining the strip against movement more than a predetermined distance away from that wall. The downstream end of the latter wall is a sharp edge 47 (FIG. 3) formed by the intersection of surface 26 with a planar plate end surface 47*a*, shown as perpendicular to the direction of strip advance; more generally, the angle between the plane of surface 47*a* and the direction of strip advance is at least sufficient to avoid cavitation effects that could cause irregularities in the coating emerging from the gap 30. Of course, if such irregularities are desired, for particular aesthetic purpose, the downstream end of the plate 18 could be shaped to provide a radiused edge that would produce such cavitation.

Preferably, in at least many instances (and especially for application of plural colors in parallel longitudinal bands), in operation the reservoir cavity 22 is kept completely filled with paint, under pressure. In this way there can be no entrapment of air in the produced coating. It is also preferred, and at present considered advantageous for attainment of satisfactory coatings, that the strip surface to be coated be primed, i.e. with a primer coat applied prior to performance of the coating operation of the present invention.

The embodiments of the apparatus of the invention illustrated in FIGS. 6–15 incorporate various arrangements for creating desired pattern effects of different shades or colors in the produced coatings. In each of these embodiments, as in the apparatus of FIGS. 2–5, a pair of plates having facing flat horizontal extended surfaces are respectively disposed on opposite sides of the path of advance of strip to be coated, for cooperatively defining a gap of uniform height and extended length in the direction of strip advance; further, in each embodiment the upper of the two plates has a portion, at the inlet end of the gap, constituting a dam extending transversely across the strip surface to be coated. Wet coating material is delivered, in each of these apparatus embodiments, into contact with the strip surface on the inlet or upstream side of the dam.

Thus, in FIG. 6, the illustrated apparatus comprises a top plate or coating head 50 and a bottom plate 52 having facing uniformly spaced extended horizontal surfaces cooperatively defining a gap 54 of extended length in the direction of strip advance represented by arrow 56. The top and bottom plates are secured together by bolts 58, with helical springs 60 under compression surrounding their shanks, for maintaining the desired spacing between the plates while permitting adjustment of that spacing.

The top plate 50 is formed in two pieces 50*a* and 50*b* which cooperatively define an upwardly opening coating cavity or reservoir 62 extending transversely of the path of strip advance across the full width of the strip. This coating cavity also opens downwardly onto the strip upper surface, through a relatively narrow opening 64 defined between the two top plate pieces 50*a* and 50*b*; the opening 64, which may, for example, be about ⅛" wide, likewise extends across the full width of the strip surface to be coated so as to permit liquid coating material from the cavity 62 to flow downwardly into contact with the strip surface. The generally vertical transverse surface 66 of plate portion 50*b*, constituting the downstream side of opening 64, serves as the dam for the coating material in this embodiment.

As a particular feature of the embodiment of FIGS. 6 and 7, a dividing member 68 extends across the cavity 62 and projects downwardly into the opening 64, for separating the cavity into two sections or chambers both extending across the full width of the path of strip advance and respectively located upstream and downstream of the opening 64. Member 68 is suspended from a rod 70 journalled in bearings 72 for rotation about an axis above and parallel to the long dimension of opening 64, i.e. to effect movement of the member 68 in the directions indicated by arrow 74.

In the operation of the apparatus of FIGS. 6 and 7, the two chambers into which cavity 62 is divided by member 68 can be respectively filled with paint of different colors. As a strip is continuously advanced through the apparatus, i.e. past the dam 66 and through the gap 54 downstream of the dam, the color of coating material delivered from cavity 62 to the strip surface can be varied by pivotal movement of the member 68 so as to produce a coating characterized by transverse bands of different shades or colors. For example, if one of the chambers of cavity 62 contains blue paint and the other contains yellow paint, pivotal movement of the member 68 can alternately admit yellow and blue paints to the opening 64 for delivery onto the strip surface, producing alternating yellow and blue bands extending transversely of the long dimension of the strip being coated; and if the member 68 is moved to an intermediate position, both yellow and blue paints can be delivered to the strip surface at the opening 64, for blending (as the strip passes through gap 54) to produce a green band.

In the embodiment shown in FIGS. 8–11, wherein some structural features have been omitted for simplicity of illustration, the same plates 50 and 52 cooperatively defining a gap 54 and providing coating cavity 62 with a central downward opening 64 and dam surface 66 are all arranged as described above with reference to FIGS. 6 and 7. The direction of strip travel again is as indicated by arrow 56. In place of the member 68, however, the embodiment of FIGS. 8–11 employs a slidable supply-controlling element 76 which (like the member 68 of FIGS. 6 and 7) divides the cavity 62 into two chambers and controls the delivery of liquid coating material from one or the other or both of these chambers to the surface of the advancing strip through opening 64. More particularly, member 76 includes a vertical portion 78 which serves to divide the cavity into the two chambers and a flat base portion 80 overlying the floor of the cavity 62. The base portion 80 has two parallel elongated slots 82 and 84 formed therein and separated by a median portion 86, slots 82 and 84 each being coextensive in length with the opening 64. Sliding movement of the element 76 in the directions represented by arrow 88 (FIG. 8) effects variation in the supply of liquid coating material from the two chambers to the opening 64. As particularly shown in FIGS. 10 and 11, the lower surface of the median portion 86 is bevelled in different directions along different parts of its length to facilitate this control of color delivery.

Figure 12:
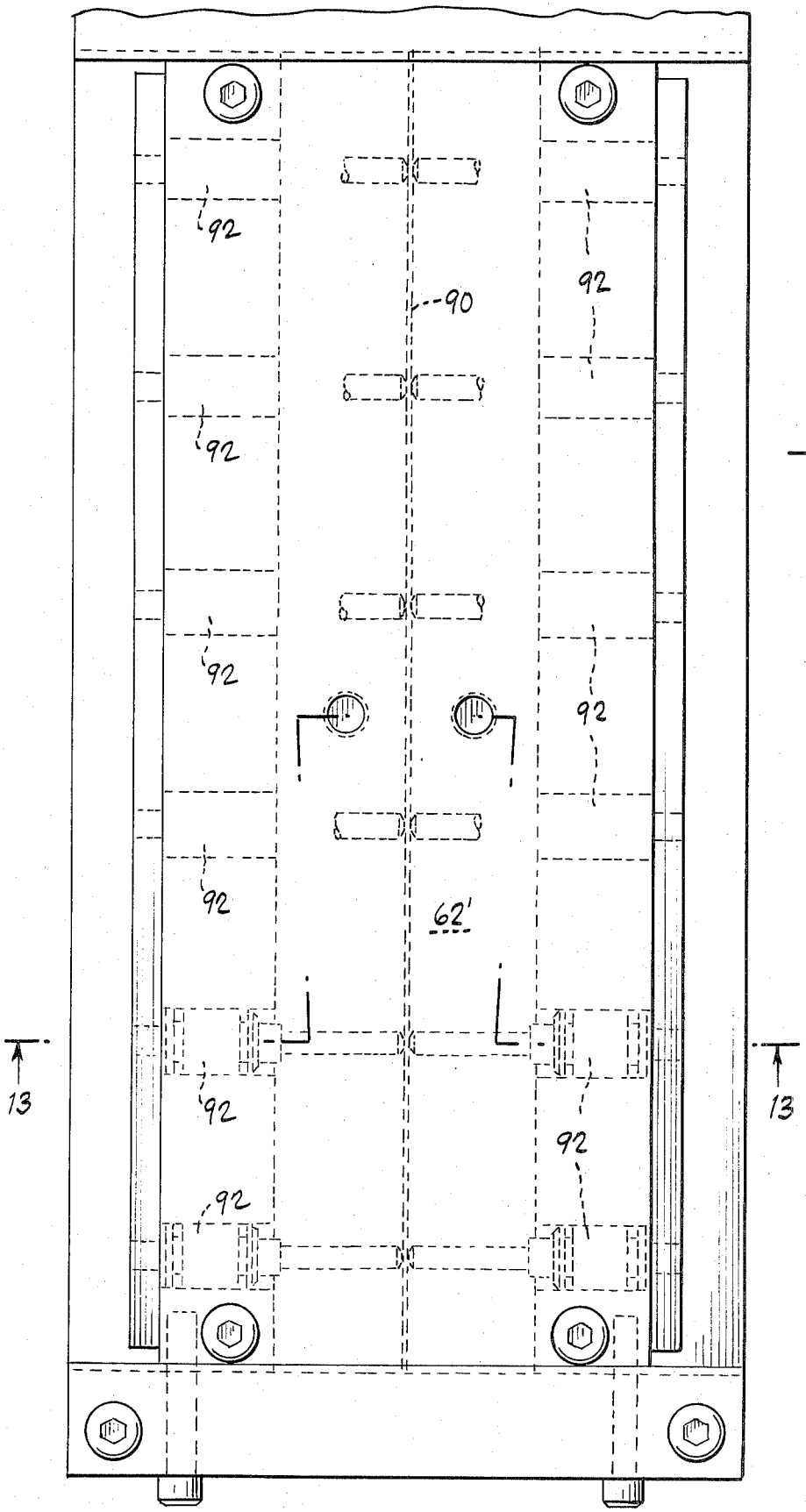
FIG. 12 is a plan view of another embodiment of the apparatus of the invention.

In the embodiment of FIGS. 12 and 13, the top plate 50' and bottom plate 52' cooperatively defining a gap 54' of uniform height and extended length in the direction 56' of strip advance are generally similar in arrangement to the plates 50 and 52 of the embodiments of FIGS. 6–11. The upper plate 50', formed in two parts, defines a coating cavity 62' communicating downwardly through an opening 64' with the surface of the strip to be coated, the downstream edge 66' of opening 64' constituting a dam.

In the embodiment of FIGS. 12 and 13, however, the cavity 62' is divided into upstream and downstream chambers by a thin spring steel member 90 which projects downwardly into the opening 64'. At each of plural (e.g. six) locations across the width of the path of strip advance, there are provided in the upper plate 50' pairs of opposed small air cylinders 92 for locally controlling the position of the spring steel divider 90. As illustrated, the pistons of each pair of the cylinders 92 project toward each other and abut the divider 90 in opposed relation so that by operation of the cylinders the divider 90 can be flexed to admit paint from either one or the other of the two coating cavity chambers into the opening 64' for delivery to the strip surface. The several pairs of cylinders 92 may be operated in unison or independently, taking advantage of the flexibility of the divider 90; thus, with paint of different colors in the two chambers of cavity 62' (these two chambers being respectively supplied with paint through ports 94 and 96), paint of one color can be delivered across the full width of the advancing strip, or alternatively paint of different colors can be delivered to different portions of the strip surface across the width thereof, by appropriate operation of the cylinders 92, i.e. flexing the divider 90 in a common direction or in a multiplicity of directions.

In the embodiment of FIGS. 14 and 15, there are, again, upper and lower stationary rigid plates respectively designated 100 and 102 with facing flat extended horizontal surfaces cooperatively defining a gap 104 of uniform height through which a strip to be coated advances in the direction represented by arrow 106. The upper plate or coating head in the embodiment of FIGS. 14–15 has plural reservoirs or cavities opening downwardly toward the strip surface to be coated; these include a main cavity 108 extending across the full width of the strip and supplied through ports 110, and two auxiliary cavities 112 located downstream of the cavity 108. Each of the cavities 112 has its long dimension oriented at an oblique angle to the long dimension of the cavity 108 and extends across only a portion of the width of the strip surface to be coated. In addition, downstream of the cavities 112, on the downwardly facing surface of the upper plate 100 (which surface constitutes the upper wall of the gap 104), there are provided plural longitudinally oriented grooves 114 which cooperate with the cavities 112 in creating a striated appearance in the produced coating.

It will be understood that all of the embodiments shown in FIGS. 6–15 function in essentially the same manner for performance of the process of the invention. That is to say, in each case a strip to be surface coated is continuously advanced through the apparatus, between the upper and lower plates thereof, while liquid coating material is continuously deposited on the upwardly facing surface of the strip from a reservoir or cavity, the downstream side of which (extending transversely across the strip surface) constitutes a dam. Immediately beyond the dam, the strip advances between upper and lower walls of a gap of extended length in the direction of strip advance, the strip moving relative to both walls, and the spacing between the walls being equal to the strip thickness plus a desired wet thickness of the applied coating layer.

In the embodiment illustrated in FIG. 16, a rigid stationary plate or coating head 120 is disposed in adjacent relation to a rotatable drum 122 having a cylindrical outer surface 124, the drum rotating about a horizontal axis in the direction indicated by arrow 126. Plate 120 has a downwardly facing smooth rigid arcuate surface 128 disposed in proximate spaced relation to the drum surface 124. This plate surface 128 is concentric with the drum surface 124 and is of extended length in the direction 126 of drum rotation, being also at least equal in width to the surface of strip to be coated by the apparatus. The spacing between surface 128 of plate 120 and drum surface 124 is uniform throughout the entire extent of surface 128; hence the drum surface 124 and the plate surface 128 respectively constitute the lower and upper walls of a gap 130 of uniform height and extended length, through which a strip article such as metal strip 132 continuously advances in the direction represented by arrow 134.

At the upstream or inlet extremity of the surface 128, the plate 120 has an edge portion 136 extending transversely across the path of strip advance and serving as a dam for liquid coating material which is deposited on the strip surface (by suitable means, not illustrated) ahead of the dam. The pool of liquid coating material thus deposited on the strip is laterally confined by plate portions 138.

The operation of the apparatus of FIG. 16 in the performance of the process of the invention is generally similar to that of the other embodiments already described, except that as the strip advances, the drum 122 is rotated in the same direction and at the same rate as the strip, so that while the strip is advancing through the gap 130 and moving relative to the upper gap wall 128 of stationary plate 120, the lower gap wall or drum surface 124 moves with the strip. That is to say, there is no relative movement between the strip and the drum surface and therefore no abrasion such as can result if the lower gap wall is stationary. The coating material deposited on the upwardly facing surface of the strip prevents abrasion between the upper strip surface and the upper wall of the gap.

FIGS. 17 and 18 illustrate one currently preferred further embodiment of the apparatus of the invention, adapted for (though not limited to) production of a coating having a pattern of lines or striations, e.g. simulating the appearance of natural wood grain, and (to that end) incorporating features described in the copending application of J. Lynn Gailey, Carl A. Wollam, and Alexander A. Chalmers for Process and Apparatus for Producing Striated Surface Coatings, filed concurrently herewith and assigned to the same assignee as the present application. In this embodiment, an aluminum strip 170 to be coated is advanced longitudinally by means including a back-up roll 172 over which the strip passes. A coating device 174 applies a coating layer 176 of paint to a major surface 178 of the strip at a locality at which the strip is held against the roll 172 with the surface 178 exposed and facing outwardly. This device includes a block or plate 180 mounted immediately adjacent the roll 172 at that locality and having a surface 182 curved concavely to conform to the surface of the roll and facing the roll in a position to define, with the roll surface, an arcuate gap through which the strip passes while being coated. A horizontally elongated, axially rectilinear reservoir trench 184 for confining a body of liquid coating material (paint) is formed in the end portion of the plate 180, and opens through the plate surface 182 toward the strip surface 178; thus the trench, which is oriented with its long dimension parallel to the axis of roll 172 and perpendicular to the direction of strip advance (represented by arrows 186), has an open long side, but is otherwise enclosed by a side wall (preferably generally semicylindrical) and flat end walls. The back-up roll 172 is positioned to maintain the strip surface 178 in proximate facing relation to the open long side of the trench so that the surface 178 constitutes a moving wall effectively closing the open trench side.

During a coating operation, the strip 170 is continuously advanced over the back-up roll while the trench 184 is maintained continuously entirely filled with paint, which deposits on the passing strip surface 178 as a continuous wet coating layer having a thickness determined by the spacing between the outlet side edge 188 of the trench and the strip surface 178. Beyond the trench the coating layer passes through a uniform gap, defined by a portion of the plate surface 182, of extended length in the direction of strip travel; the provision of this gap aids in assuring the smoothness and uniformity of thickness of the coating emerging from beneath the sharp outlet edge 190 of the plate 180.

Three paint-delivery apertures (respectively designated 192, 194 and 196) are formed in the side wall of the trench 184, at localities spaced apart along the length of the trench and spaced from (viz. directly opposite) the open long side of the trench. The central aperture 194 is positioned halfway between the ends of the trench; the apertures 192 and 196 are respectively positioned between the aperture 194 and the opposite ends of the trench, at distances (from aperture 194) each equal to one third of the total length of the trench, so that the three apertures are respectively centered in adjacent thirds of the length of the trench.

Each aperture constitutes the open outlet end of a main bore extending through the plate 180 and having a T-junction with a transverse bore in the plate at a locality spaced from the aperture. The arrangement of main bore 198 and transverse bore 200 associated with aperture 192 is shown in FIG. 18; the other two apertures, 194 and 196, have identical bore arrangements. A supply 202 of paint of a first color, including a pump **202*a* and valves 202*b*, is connected to the main bore associated with each of the three apertures, while a supply 204 of paint of a second color, also including a pump and valves, is connected to the transverse bore of each aperture, as represented diagrammatically in FIG. 18**. The main and transverse bores associated with each aperture, together with the paint supplies, cooperatively constitute means for delivering concurrent laminar flows of two liquid coating materials (two colors of paint) to the trench along a common path through that aperture.

Conveniently, for the illustrative example of operation now to be described, the two colors of paint are supplied to the device of FIGS. 17 and 18 at the same, substantially constant pressure, and the relative flows of the two colors at each aperture are determined by fixed orifice size, e.g. by the relative diameters of the main and transverse bores, such that a major flow of the first-color paint and a minor flow of the second-color paint enter the trench at each aperture. Thus, the supply 202 may include a single pump **202*a* but three valves 202*b* (downstream of the pump) for respectively separately controlling supply of the first color paint to the three main bores 198, while the supply 204 likewise includes a single pump 204*a* but three valves 204*b* for respectively separately controlling supply of the second-color paint to the three transverse bores 200. In a simple yet effective mode of operation, to which detailed reference will be made below, the two valves 202*b* and 204*b*** associated with each aperture are electrically controlled to cause simultaneous starting or stopping of flow of both colors of paint through that aperture.

When the apparatus of FIGS. 17 and 18 is operated in this mode, with the strip 170 being continuously longitudinally advanced and the trench 184 being maintained continuously entirely filled with paint delivered at all three of the apertures 192, 194 and 196 (i.e. all of the valves **202*b* and 204*b* being open), the coating layer applied to the strip surface 178 comprises three contiguously adjacent longitudinal portions (positionally indicated by letters a, b, and c in FIG. 17) respectively constituted of paint delivered at the apertures corresponding positionally to those coating portions. Thus, coating portion a is constituted of paint delivered to the trench at aperture 192; coating portion b is constituted of paint delivered at aperture 194; and coating portion c is constituted of paint delivered at aperture 196**. The relative widths of coating portions a, b and c are directly proportional to the relative total flows of paint respectively delivered at the corresponding apertures. This observed result indicates that the paint delivered at each aperture fills only the portion of the length of the trench adjacent that aperture, and does not intermix with the paint being delivered to an adjacent portion of the trench through an adjacent aperture, notwithstanding that the trench is continuous and undivided along its length. Given the conditions described above, viz. that all the valves are open and that the paint of both colors is supplied at the same pressure to all apertures, the paint delivered at each aperture fills one third of the trench and the coating portions a, b and c are equal to each other in width.

Within the portion of the paint layer corresponding to each aperture, there is produced a pattern of multiple longitudinal striations of the two colors of paint delivered to the trench at that aperture in concurrent laminar flows. Thus, from the three apertures of FIG. 17 there are produced three parallel patterns of longitudinal striations. It is believed that within the portion of the trench supplied through each aperture, there is established an essentially separate helical laminar flow pattern of the two colors of paint so that there are three such patterns, arranged side by side along a common axis, respectively located adjacent the three apertures in the trench of FIG. 17; and it is further believed that the striated pattern results from impingement of the turns of these helical flows on the advancing strip surface.

When delivery of paint through any one of the apertures is interrupted by operation of its associated valves, the supply of paint already delivered to the trench through that aperture is progressively depleted by deposit on the advancing strip surface, and occupies a progressively shorter portion of the trench (measured along the trench length); accordingly, the coating portion a, b, or c produced by deposit of paint from that aperture becomes progressively narrower along the length of the strip. At the same time, paint continuing to be delivered through one or both of the other apertures progressively occupies a greater portion of the trench length (so that the trench continues to be entirely filled with paint), and in consequence, the coating portion or portions produced by deposit of paint from such other aperture or apertures will exhibit progressive widening along the length of the strip in correspondence with the narrowing of the first-mentioned coating portion. Thus, by alternate and sequential shutoff and resumption of paint flow through the three apertures, there is achieved alternate widening and narrowing of the three coating portions a, b and c along the strip length, while the overall width of the coating remains constant.

As any one of the coating portions a, b and c becomes wider or narrower, the striations contained therein are progressively displaced transversely of the strip, so that (as indicated at 176*a* in FIG. 17) they appear to extend diagonally rather than parallel to the long edges of the strip, although (as further indicated at 176*a*) typically each such diagonal striation is constituted of a staggered array of short parallel striations; as at present believed, this progressive transverse displacement of the striations in the produced coating is a result of progressive axial expansion or compression of the helical flows within the trench incident to the described selective shutoff and resumption of paint supply through the several apertures. In addition to the change in orientation of the striations, the widening or narrowing of the coating portions produces progressive variation in the spacing between adjacent striations and in the degree of blending of the two colors of paint (with consequent variation in apparent width of the striations), all in conformity with the appearance of natural wood grain. Thereby, highly effective simulation of wood grain can be achieved in the produced pattern.

The plate 180 is provided with lateral projections 206 to facilitate mounting of the plate on appropriate support structure for holding the plate fixed in relation to the axis of the roll 172. The mounting for the plate may include means (not shown) for adjusting the spaced position of the plate relative to the roll axis, thereby to vary the gap defined between the roll surface and the plate surface 182, as may be desired to accommodate strip of different gauges and/or to change the wet thickness of the applied coating layer.

While the coating system of FIGS. 17 and 18 has been described as operated to produce a striped or striated coating, it is to be understood that this system is applicable as well to the production of a single-color coating, with the advantages already noted that the coating is characterized by superior smoothness and uniformity owing to the prevention of entrapment of air (a result, *inter alia,* of the feature of maintaining the trench continuously entirely filled with liquid coating material under positive pressure), and that abrasion is avoided because the surface of the back-up roll moves in the same direction and at the same rate as the advancing strip. For production of a single-color coating, only one wet coating material is delivered to the trench, and such delivery can be effected through only a single one of the paint-delivery apertures, i.e. with supply of paint through the associated main bore; indeed, in such case the apparatus can be provided with a single (e.g. centrally located) aperture and an associated single main bore, the transverse bore and the otherapertures (with their associated main bores) being omitted.

Figure 19:
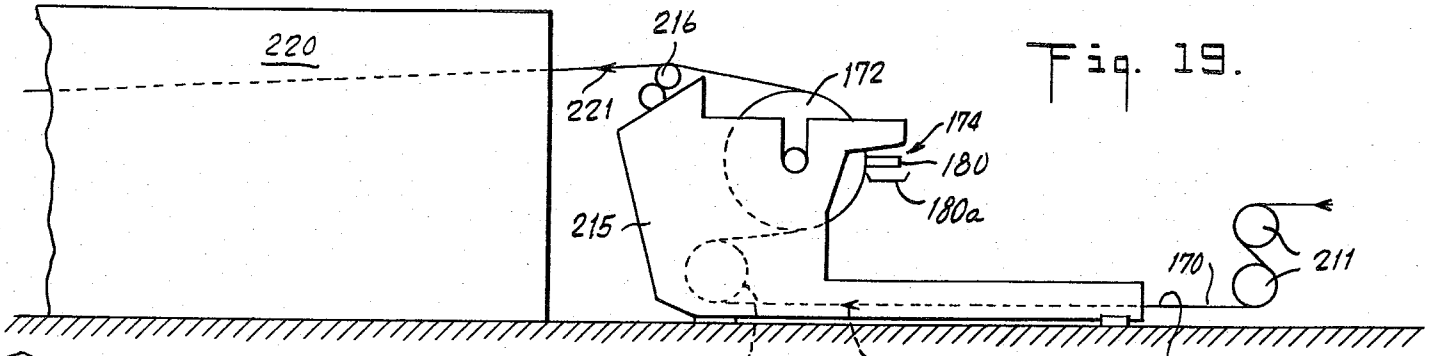
FIG. 19 is a schematic side elevational view of a coating line incorporating the embodiment of FIGS. 17–18.

In the coating line schematically shown in FIG. 19, incorporating the coating device 174 of FIGS. 17 and 18, the aluminum strip 170 to be coated is continuously advanced (by suitable and e.g. conventional strip-advancing means) longitudinally parallel to its long dimension from a coil (not shown) around rolls 211 and a guide roll 212, and thence over the back-up roll 172 (rotatably supported, with roll 212, in a frame 215) and a further roll 216. At a locality at which the strip is held against the back-up roll, paint is applied to the outwardly facing major surface 178 of the strip from the coating device 174, to establish on the strip surface 178 a continuous layer or coating of the paint. Beyond the roll 216, the strip is passed through an oven 220 to dry the coating, and thereafter coiled again, e.g. on a driven rewind roll (not shown) which, in such case, constitutes the means for advancing the strip through the coating line; within the oven, the advancing strip is in catenary suspension, and the weight of the suspended portion holds the strip against the back-up roll 172. The direction of strip advance through the coating line is indicated by arrows 221.

As will be understood from the foregoing description of FIGS. 17 and 18, the coating device 174 includes the plate 180 having a reservoir trench (not shown in FIG. 19) with an open long side which extends, transversely of the path of strip advance, from end to end of the trench. The back-up roll 172 supports the strip surface 178 in proximate facing relation to the open side of the trench as the strip passes the trench.

As shown in FIG. 19, the plate 180 is preferably so disposed that its trench, facing back-up roll 172, lies substantially in a horizontal plane containing the axis of rotation of the back-up roll, and the coating line is so arranged that the strip is held against the back-up roll at this locality, which is thus the locality at which paint is applied to the strip. It will be understood that in continuous coating of strip, successive lengths of strip are usually joined together (spliced) endwise at a transverse seam which is thicker than the strip gauge; when this seam passes between the plate 180 and roll 172, the plate must be temporarily moved away from the roll sufficiently to accommodate the thickness of the seam. If, for example, the plate 180 were located above the roll 172, so that the trench opened downwardly, such movement of the plate away from the roll would cause the paint then contained in the trench to be dumped on the passing strip surface, resulting in unsatisfactory coating of the strip for many feet beyond the seam. The disposition of the plate shown in FIG. 19 largely obviates this problem because paint in the trench, when released by movement of the plate away from the strip, falls into a drip pan 180*a* rather than onto the strip surface, and therefore does not interfere with resumed application of a satisfactory coating layer upon return of the plate to operative position. In consequence, production of unacceptably coated scrap strip is advantageously minimized.

Figure 20:
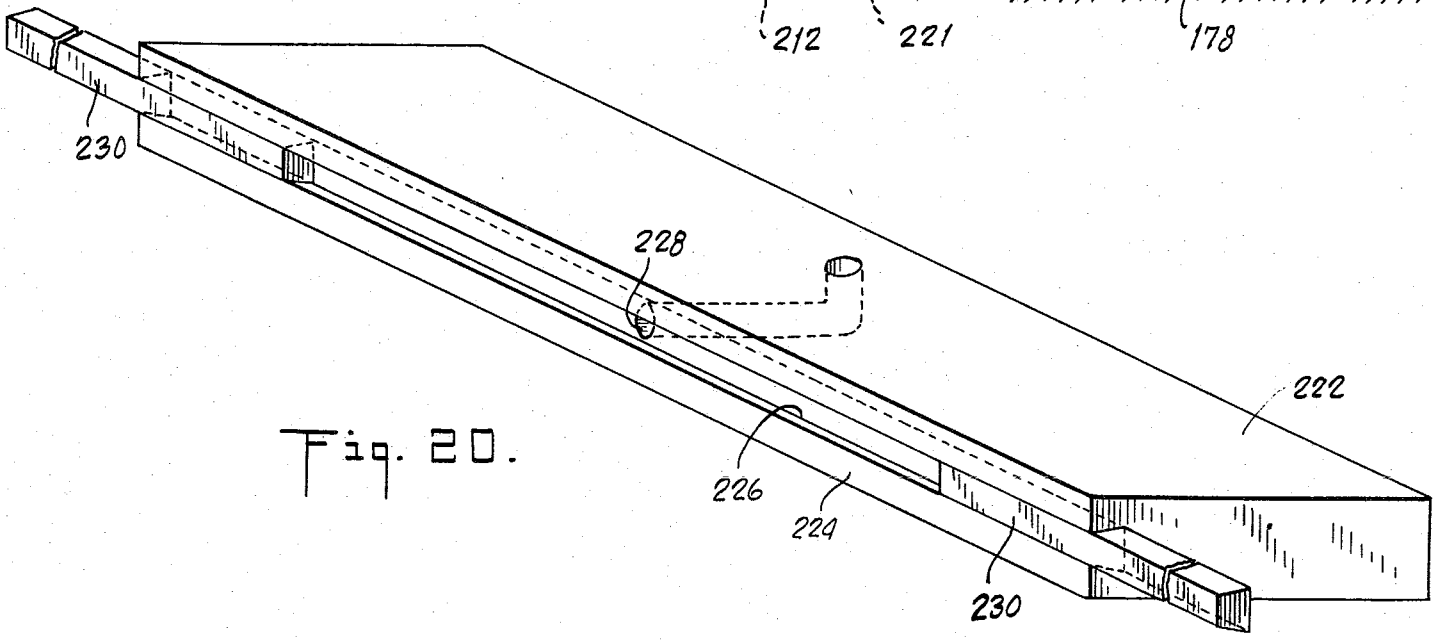
FIG. 20 is a simplified schematic perspective view of another embodiment of the invention.

Although the plate structures described above define trenches having fixed ends, and thus a fixed length, it is advantageous to enable the length of the trench to be adjusted, thereby to vary the width of the applied coating e.g. to facilitate use of the same apparatus to coat strips of different widths. FIG. 20 illustrates schematically a plate 222 having a surface 224 in which is formed an elongated, axially rectilinear trench 226 supplied with paint through an aperture 228, for use in the same manner as the plates described above in applying a coating to a strip article. The trench 226 extends for the full length of the plate, opening through the opposite sides thereof, and is closed at its ends by a pair of shutter members 230 which are snugly but slidably inserted into the opposed extremities of the trench. Means (e.g. clamps, not shown, secured to the plate 222 and adjustably engaging the shutter members) may be provided for holding the shutter members in any desired position. The length of the trench, and consequently the width of the applied coating, can be varied as desired by moving the shutter members longitudinally toward or away from each other within the trench. Thus, for example, in the coating of metal strip for use in making siding panels, the coating layer width can readily be selected to be somewhat less than the strip width, so that both longitudinal edge portions of the coated strip surface are left bare to permit direct metal-to-metal contact between adjacent courses of panels (i.e. when the panels are formed, cut, and installed on a building wall) as is desired to render the panel assembly electrically conductive.

In addition to providing the beneficial results already discussed, the above-described coating systems and procedures (especially those embodiments wherein the paint or other liquid coating material is supplied under pressure to a fully enclosed reservoir or trench which is maintained entirely filled with the liquid) afford other important advantages, with respect to operating economy and efficiency and eivnronmental considerations, as compared to conventional roll-coating systems. The mechanical simplicity of the present systems, which have no coating rolls to maintain, reduces capital investment and maintenance costs as well as saving the energy required to rotate coating rolls. Since the systems are fully enclosed, i.e. applying a coating directly from an enclosed trench to which the paint is supplied under pressure, there is no exposed or visible paint (in open reservoirs or on rolls); hence contamination with dirt is minimized, and splashing or dripping of paint is avoided, so that the operation is advantageously clean and waste of paint is minimized. For the same reason, coatings having a high solids content (and a correspondingly low solvent content) can be applied at high line speeds, whereas with conventional rollers centrifugal effects restrict the speeds at which high-solids coatings can be applied. Such rapid application of high-solids coatings and reduced use of solvents is both economically and environmentally beneficial. Coating color changes can be effected much more rapidly, and with production of much less scrap (strip that passes the coating station and is not satisfactorily coated during a color change), than in the case of roll coating operations, which require relatively lengthy cleanup and reset times for color changes. Thus, the present systems facilitate production of special color coatings in short runs.

Moreover, the present systems achieve smoother, finer-textured coatings than are produced by roll coating, owing in particular (as at present believed) to the extended surface or land which the coated strip passes immediately beyond the trench. Problems of blistering due to air entrapment, a cause of much poor or unsatisfactory coating in conventional operations, are eliminated by the long land and by the application of the coating material under pressure in a fully filled and enclosed trench. A still further advantage is that (as already mentioned) the width of the applied coating can be made narrower than the strip; and there is no build-up of a relatively thick bead of coating material along the edges of the coated strip, as occurs in conventional roll coating. Since the bead, if present, interferes with proper recoiling of the coated strip unless special measures (e.g. involving periodic axial movement of the recoil drum) are taken to accommodate it, the avoidance of bead formation is especially desirable.

It is to be understood that the invention is not limited to the features and embodiments hereinabove specifically set forth but may be carried out in other ways without departure from its spirit.

We claim:

1. A process for coating a major surface of a strip article of indeterminate length, including the steps of (a) continuously advancing the article longitudinally past a coating head including a dam extending transversely of said major surface in adjacent spaced relation thereto while (b) supplying a wet flowable coating material through said coating head to said major surface immediately ahead of said dam such that said flowable coating material forms a continuous layer between said dam and said article, wherein the improvement comprises (c) immediately beyond said dam, advancing said article longitudinally past a wall of said coating head, said wall being of extended length in the direction of strip advance and facing said major surface, while (d) uniformly restraining the strip against movement of said major surface away from said wall beyond a predetermined distance equal to a desired wet thickness of said layer of coating material on said major surface, said layer of coating material being the sole means located between said wall and said major surface for restraining said strip from movement of said major surface toward said wall, and while (e) maintaining said strip major surface, ahead of said dam, spaced away from said coating head.

2. A process according to claim 1, wherein said article is restrained as aforesaid by a second wall spaced uniformly from the first-mentioned wall to define therewith a gap through which the article passes, and wherein said article passing through said gap moves relative to both of said walls.

3. A process according to claim 1, wherein the step of supplying the coating material includes supplying coating materials of differing compositions to different portions of said major surface across the width thereof ahead of said dam.

4. A process according to claim 3, wherein said different compositions of coating material differ from each other in color.

5. A process according to claim 3, wherein the step of supplying coating material to said major surface comprises maintaining a continuous liquid body of coating material on said major surface extending across the full width thereof ahead of the dam, and wherein coating materials of different compositions are respectively supplied to different portions of said body along the length thereof.

6. A process according to claim 3, including the step of varying the supply of different coating material compositions to said major surface for producing variations in coating appearance along the length of said major surface.

7. A process according to claim 1, wherein the step of supplying coating material to said major surface comprises supplying coating material of different compositions to different portions of the major surface along the length thereof.

8. Apparatus for forming a continuous adherent coating layer on a major surface of a strip article of indeterminate length, comprising (a) means defining a path of longitudinal advance of said article, including a coating head comprising an extended wall facing said major surface of said article and so arranged that the advancing article moves longitudinally relative thereto;

(b) means included in said coating head at one end of said wall constituting a dam extending transversely of the path of article advance so as to be disposed in adjacent spaced relation to the article major surface facing said wall;

(c) means for supplying a wet flowable coating material through said coating head to the last-mentioned article major surface ahead of said dam such that said flowable coating material forms a continuous layer between said dam and said article; and (d) means for uniformly restraining said article against movement of said major surface away from said wall beyond a predetermined distance during advance of said article past said wall;

(e) said path-defining means being further so arranged that said layer of coating material is the sole means located between said wall and said major surface for restraining said strip from movement of said major surface toward said wall, and (f) said path-defining means being arranged to maintain said strip major surface, ahead of said dam, spaced away from said coating head.

9. Apparatus as defined in claim 8, wherein said supply means includes means for delivering at least two different coating material compositions to different portions of said last-mentioned article major surface ahead of said dam.

10. Apparatus as defined in claim 8, comprising two equidistantly spaced rigid plates, having facing surfaces respectively constituting said wall and said restraining means, a surface portion of one of said plates at the inlet end of said gap constituting said dam, and means for fixedly securing said plates relative to each other.

11. Apparatus as defined in claim 10, wherein said securing means is adjustable for varying the spacing between said facing surfaces of said plates.

12. Apparatus as defined in claim 8, wherein the end of said wall remote from said one end is formed as a sharp edge for preventing cavitation of wet coating material on the article major surface advancing beyond the wall.

13. Apparatus as defined in claim 8 or 12, wherein said one end of said wall has a surface gradually and progressively approaching said wall in the direction of strip advance.

14. A process for coating a major surface of a strip article of indeterminate length, including the steps of (a) continuously advancing the article longitudinally past a coating head including a dam extending transversely of said major surface in adjacent spaced relation thereto while (b) supplying a wet flowable coating material through said coating head to said major surface immediately ahead of said dam, wherein the improvement comprises (c) immediately beyond said dam, advancing said article longitudinally past a wall of said coating head, said wall being of extended length in the direction of strip advance and facing said major surface, said wall terminating in an abrupt discontinuity for preventing cavitation of wet coating material on said major surface, while (d) uniformly restraining the strip against movement of said major surface away from said wall beyond a predetermined distance equal to a desired wet thickness of said coating material on said major surface by positively preventing divergence between said major surface and said wall in the direction of strip advance ahead of said discontinuity, and while (e) maintaining said strip major surface, ahead of said dam, spaced away from said coating head.

15. Apparatus for forming a continuous adherent coating layer on a major surface of a strip article of indeterminate length, comprising (a) means defining a path of longitudinal advance of said article, including a coating head comprising an extended wall facing said major surface of said article and so arranged that the advancing article moves longitudinally relative thereto;

(b) means included in said coating head at one end of said wall constituting a dam extending transversely of the path of article advance so as to be disposed in adjacent spaced relation to the article major surface facing said wall;

(c) means for supplying a wet flowable coating material through said coating head to the last-mentioned article major surface ahead of said dam;

(d) said wall terminating, at a second end remote from said one end, in an abrupt discontinuity for preventing cavitation of wet coating material on said major surface; and (e) means for uniformly restraining said article against movement of said major surface away from said wall beyond a predetermined distance during advance of said article past said wall by positively preventing divergence between said major surface and said wall in the direction of strip advance ahead of said discontinuity;

(f) said path-defining means being arranged to maintain said strip major surface, head of said dam, spaced away from said coating head.

16. A process as defined in claim 1, wherein said coating material is paint and said strip article is a strip of sheet metal.

17. A process as defined in claim 1, wherein the step of supplying wet flowable coating material to the strip major surface comprises delivering said coating material to an enclosed reservoir formed in said coating head and having an opening facing said strip major surface such that coating material in said reservoir is in contact therewith, said opening extending transversely of said strip major surface and being defined by said dam and by a portion of said coating head disposed ahead of and in spaced parallel relation to said dam, while maintaining said strip major surface spaced away from said last-mentioned portion of said coating head.

18. Apparatus as defined in claim 8, wherein said coating material supplying means includes an enclosed reservoir formed in said coating head and having an opening facing said strip major surface for contact of coating material in said reservoir with said strip major surface, said opening extending transversely of the path of article advance and being defined by said dam and by a portion of said coating head disposed ahead of and in spaced parallel relation to said dam; said path-defining means being arranged to maintain said strip major surface spaced away from said last-mentioned portion of said coating head.

* * * * *